US006220331B1

(12) United States Patent
Matsuda et al.

(10) Patent No.: US 6,220,331 B1
(45) Date of Patent: Apr. 24, 2001

(54) DEVICE FOR ATTACHING ADHESIVE TAPE

(75) Inventors: Naohiko Matsuda; Takanori Toyoda, both of Matsuzaka; Nagahisa Kameda, Kouga-gun, all of (JP)

(73) Assignee: Central Glass Co., Ltd., Ube (JP)

( * ) Notice: Subject to any disclaimer, the term of this patent is extended or adjusted under 35 U.S.C. 154(b) by 0 days.

(21) Appl. No.: 09/294,713

(22) Filed: Apr. 20, 1999

(30) Foreign Application Priority Data

Apr. 20, 1998 (JP) ..... 10-109587

(51) Int. Cl.[7] ..... B32B 35/00

(52) U.S. Cl. ..... 156/566; 156/235; 156/510; 156/538; 156/539; 156/556

(58) Field of Search ..... 156/256, 510, 156/517, 521, 538, 539, 235, 552, 556, 566

(56) References Cited

U.S. PATENT DOCUMENTS 3,625,799 * 12/1971 Way .
3,654,038 * 4/1972 Hottendorf .
3,765,992 * 10/1973 Stageberg .
3,892,618 * 7/1975 Griebat .
3,895,989 * 7/1975 Lucas .
3,963,557 * 6/1976 Patterson .
4,003,780 * 1/1977 Cohn .
4,181,559 * 1/1980 Hudson .
4,317,694 * 3/1982 Fuchs et al. .
4,925,521 * 5/1990 Asbury, Jr. et al. .
5,429,576 * 7/1995 Doderer-Winkler .
5,779,830 * 7/1998 Wakefield et al. .
6,022,443 * 2/2000 Rajala et al. .

FOREIGN PATENT DOCUMENTS 53-43794 11/1978 (JP) .
5-69014 9/1993 (JP) .

* cited by examiner

*Primary Examiner*—Curtis Mayes
(74) *Attorney, Agent, or Firm*—Pillsbury Winthrop LLP

(57) ABSTRACT

A method for attaching an adhesive tape includes the steps of, disposing the adhesive tape having an adhesive surface on a support body with the adhesive surface down, rolling an attaching roller having adhesive strength on the other not-adhesive surface of the adhesive tape so that the adhesive tape is transferred onto the attaching roller and is come into tight contact therewith, and rolling the attaching roller on a surface of a member to be attached which is located in a predetermined position so that the adhesive tape adhered to the attaching roller is attached onto the surface of the member. Respective adhesive strengths A, B and C are set to have a relation of A<B<C, where A designates adhesive strength between the adhesive surface of the adhesive tape and the support body, B designates adhesive strength between the not-adhesive surface of the adhesive tape and the attaching roller, and C designates adhesive strength between the adhesive surface of the adhesive tape and the member to be attached.

7 Claims, 5 Drawing Sheets

DEVICE FOR ATTACHING ADHESIVE TAPE

BACKGROUND OF THE INVENTION

1. Field of the Invention

The present invention relates to a method and a device for attaching an adhesive tape onto variously shaped members to be attached, and particularly to a method and a device for attaching an adhesive tape such as masking tape and the like onto a plate-like body such as a bent vehicle window glass or the like automatically when painting, coating, chemical treatment or the like is given to the surface of the plate-like body.

2. Description of the Related Art

Conventionally, a wide variety of methods or devices for automatically attaching an adhesive tape to a member to be attached have been known. Particularly, various methods or devices for attaching masking tapes onto surfaces of flat plate-like members such as substrates, or labeling machines for attaching labels to curved surfaces of bottles, cans, etc., are known.

For example, JP-B-53-43794 discloses a labeling machine for attaching labels onto bottles or the like. The labeling machine includes a labeling mechanism constituted by absorption drums for absorbing labels from a label holder and an attaching drum for absorbing labels and pressing the labels onto side surface of bottles or the like. In the labeling machine, the absorption drums are disposed apart from the attaching drum, each of the absorption drums being provided with a receiving frame for receiving a label on the attaching drum side and in a position along the traveling direction of the attaching drum, and further provided with a member for pressing the label in the receiving frame onto the side surface of the attaching drum.

Further, as for the machine for attaching masking tape to a printed board, JP-U-5-69014 discloses a masking tape attaching machine. This machine includes a tape support portion for rotatably supporting a roll-like masking tape, two tape pressing rollers disposed side by side in the tape-attaching direction so as to be able to individually move up and down and to press the fed masking tape onto the printed board, a cutter disposed between the two tape pressing rollers for cutting the tape in the state where the tape pressing roller on the tape support portion side is in the moving-up position while the other tape pressing roller is pressing the masking tape, and a moving means for moving the tape support portion, the tape pressing rollers and the cutter as a whole in the tape attaching direction.

The related art-type masking and tape attaching machines have a main function that attaches tapes continuously. Accordingly, they are not good at partial tape attaching. In addition, most of mechanisms of a tape feeding unit, a cutting unit, and an attaching unit are integrated and disposed continuously, so that the posture of tape attaching is limited.

On the other hand, the labeling machines have a main function that attaches labels partially, and supplied paper is limited to paper with peeling sheet. Accordingly, there was a problem that it is necessary to prepare supplied paper attached with labels having a required size or length in advance.

For example, the method disclosed in JP-B-53-43794 discloses a method for attaching a label onto a substantially cylindrical portion of a bottle, a can or the like, in which a label is absorbed onto an absorption drum so as to be delivered to an attaching drum, and paste is applied to the label absorbed on the attaching drum by a pasting drum. Thus, the label is attached to a bottle or the like. In such a manner, the number of times of delivery of a label among the drums is very large. Further, means for absorbing a label onto the drums uses a vacuum. Accordingly, there is a problem that the structure and the timing control are so complicated that it is difficult to apply the method to such a case where tape is attached onto opposite surfaces of a large-sized and curved plate-like body.

On the other hand, in the machine disclosed in the above JP-U-5-69014, masking tape is attached onto the flat surface of a printed board or the like. It is therefore difficult to apply the machine to a case of attaching tape onto opposite surfaces of a curved plate-like body.

SUMMARY OF THE INVENTION

The present invention is intended to solve the foregoing problems. That is, it is an object of the invention to provide an simple adhesive tape attaching method and device, in which tape-like pieces cut in advance can be attached to a desired position of a member to be attached, in which various required size pieces of tape can be fed sequentially without using any peeling sheet, and in which adhesive tape pieces can be attached to various desired positions without being limited in its attaching posture and without causing bubbles or wrinkles when the tape pieces are attached onto the member to be attached.

In order to achieve the above object, according to an aspect of the present invention, there is provided a method for attaching an adhesive tape includes the steps of, disposing the adhesive tape having an adhesive surface on a support body with the adhesive surface down, rolling an attaching roller having adhesive strength on the other not-adhesive surface of the adhesive tape so that the adhesive tape is transferred onto the attaching roller and is come into tight contact therewith, and rolling the attaching roller on a surface of a member to be attached which is located in a predetermined position so that the adhesive tape adhered to the attaching roller is attached onto the surface of the member. Respective adhesive strengths A, B and C are set to have a relation of $A<B<C$, where A designates adhesive strength between the adhesive surface of the adhesive tape and the support body, B designates adhesive strength between the not-adhesive surface of the adhesive tape and the attaching roller, and C designates adhesive strength between the adhesive surface of the adhesive tape and the member to be attached.

According to another aspect of the present invention, there is provided a device for attaching an adhesive tape including, a tape cutting unit for cutting a roll-like adhesive tape into adhesive tape pieces, a tape feeding unit including a conveyor belt for conveying the adhesive tape pieces disposed thereon with their adhesive surfaces down so as to be in contact with the conveyor belt, an attaching roller having enough adhesive strength to press not-adhesive surfaces of the adhesive tape pieces arranged on the conveyor belt so that the adhesive tape pieces are transferred to come into tight contact with the attaching roller, and a robot for making the attaching roller movable and rotatable along X, Y, Z and θ axes.

DETAILED DESCRIPTION OF THE PREFERRED EMBODIMENT

Figure 1:
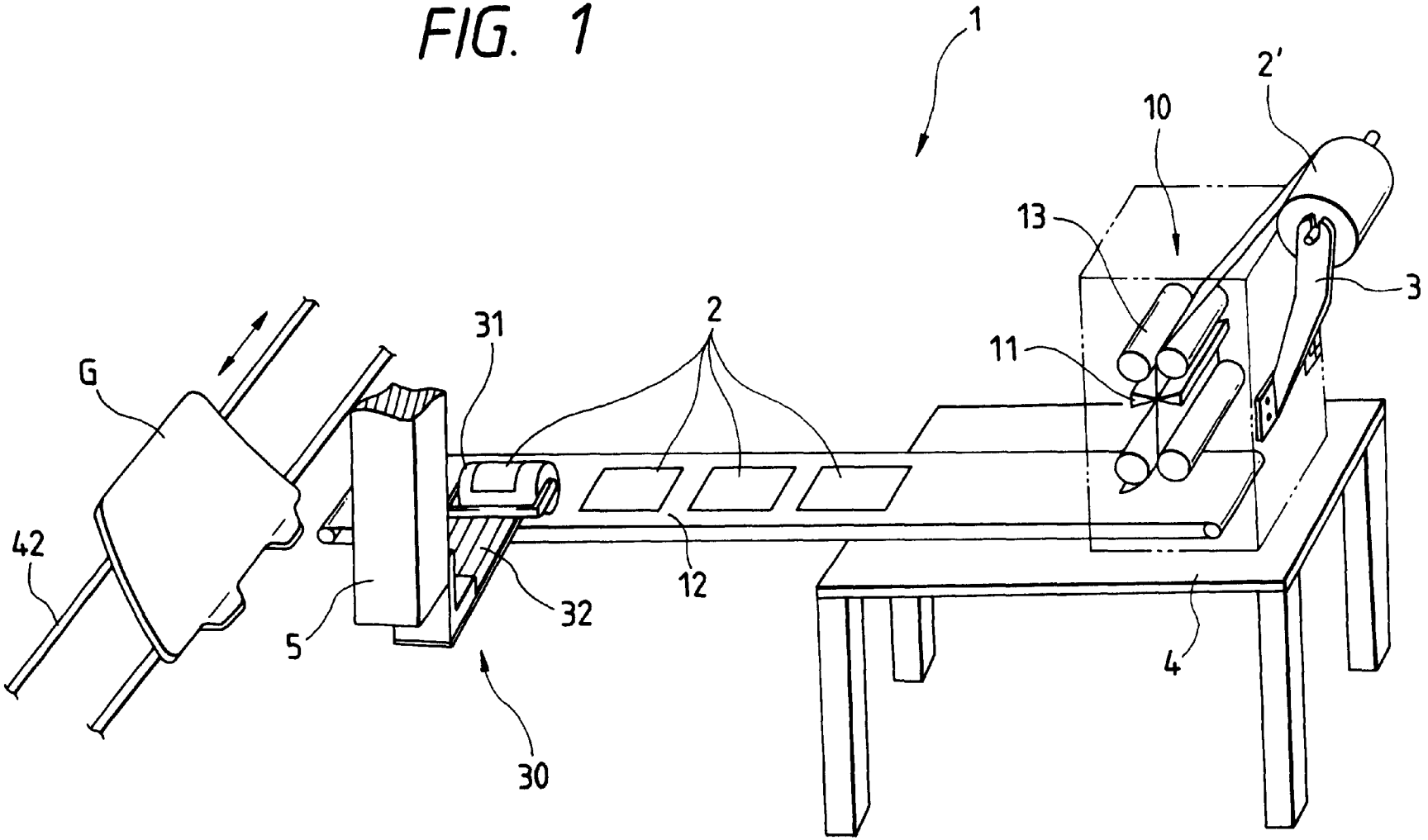
FIG. 1 is a main part perspective view of an embodiment of the present invention, for explaining a state where adhesive tape pieces supplied are transferred to and put into contact with an attaching roller of an attaching means.

The present invention provides a method and a device 1 for attaching adhesive tape pieces 2 to desired places of a plurality of surfaces of a member to be attached, for example, of opposite surfaces of a plate-like body G, or the like. An attaching roller 31 made of adhesive material, which is an attaching means 30 is provided at a tip end of a hand 5 of a robot movable and rotatable along the X, Y, Z and θ axes. The roller 31 is rolled while it is pressed against the not-adhesive surface on the upper surface side of one of the adhesive tape pieces 2 put on a support body. Thus, the adhesive tape pieces 2 are transferred one by one to the attaching roller 31 and brought into tight contact therewith sequentially. Next, the robot hand 5 rolls the attaching roller 31 while pressing the roller 31 so that the adhesive tape pieces 2, 2, . . . in tight contact with the outer circumferential surface of the attaching roller 31 are pressed one by one onto a plurality of places on the opposite surfaces of the plate-like body G positioned in a predetermined position by a plate-like conveyor device (not shown).

As shown in FIG. 1, a tape feeding device 10 provided on a frame 4 is constituted by a cutter 11 and a conveyor belt 12. Roll-like adhesive tape 2' supported by a holder 3 is fed from its head, and cut by the cutter 11 into pieces of a predetermined size successively. The conveyor belt 12 conveys adhesive tape pieces 2, 2, . . . successively cut by the cutter 11. The adhesive tape pieces 2, 2, . . . cut into a predetermined size are put and conveyed successively on a support body constituting the conveyor belt 12. The conveyor belt 12 has been subjected to a treatment for reducing its adhesive strength when the conveyor belt 12 comes into contact with the adhesive surfaces of the adhesive tape pieces 2, 2, . . . in a condition that the adhesive tape pieces 2, 2 . . . are put on the conveyor belt 12 with their adhesive surfaces down.

The conveyor belt 12 has a surface subjected to roughing or embossing finish and coated with silicon, so that the adhesive tape pieces 2, 2, . . . are difficult to adhere to the support body constituting the conveyor belt 12 even if the adhesive tape pieces 2, 2, . . . are put on the conveyor belt 12 with their adhesive surfaces down.

The conveyor belt 12 is driven by a conveyor motor (not shown) to convey the adhesive tape pieces 2 cut by the cutter 11 to the vicinities of the plate-like body G, which is a member to be attached, and a not-shown robot.

Figure 2A:
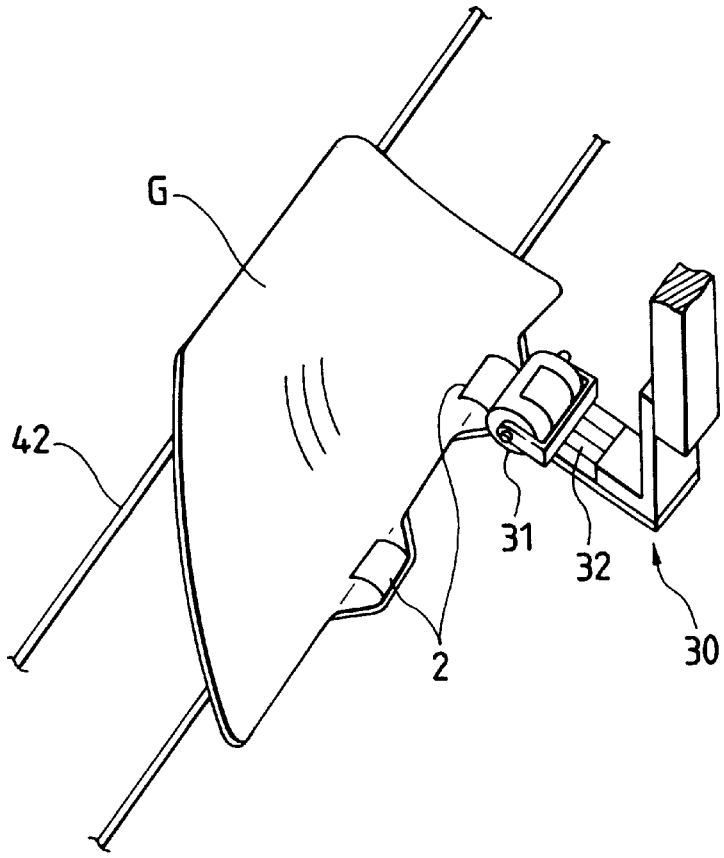
FIG. 2A is a partially perspective view of an embodiment of the present invention, for explaining a state where adhesive tape pieces are attached to a plate-like body.
Figure 2B:
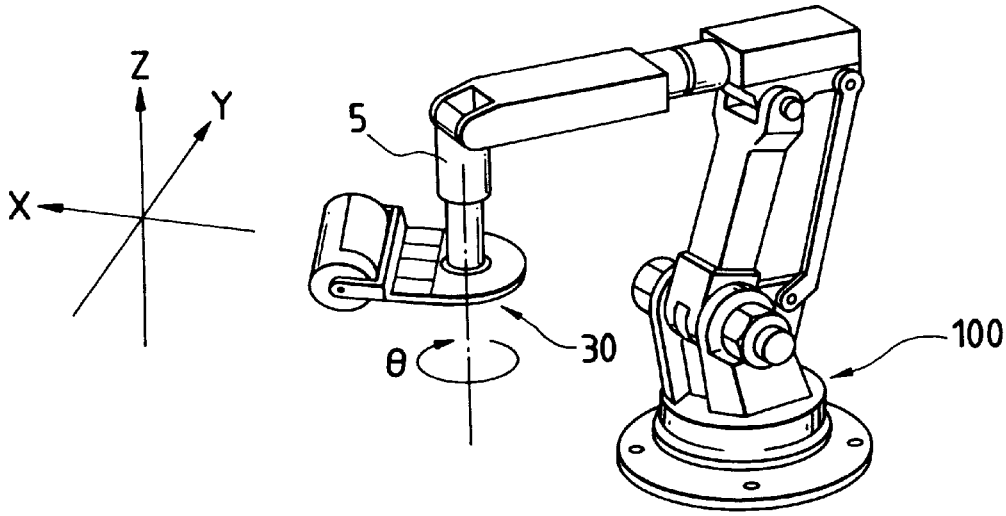
FIG. 2B is a partially perspective view showing a robot hand of the present invention.
Figure 3:
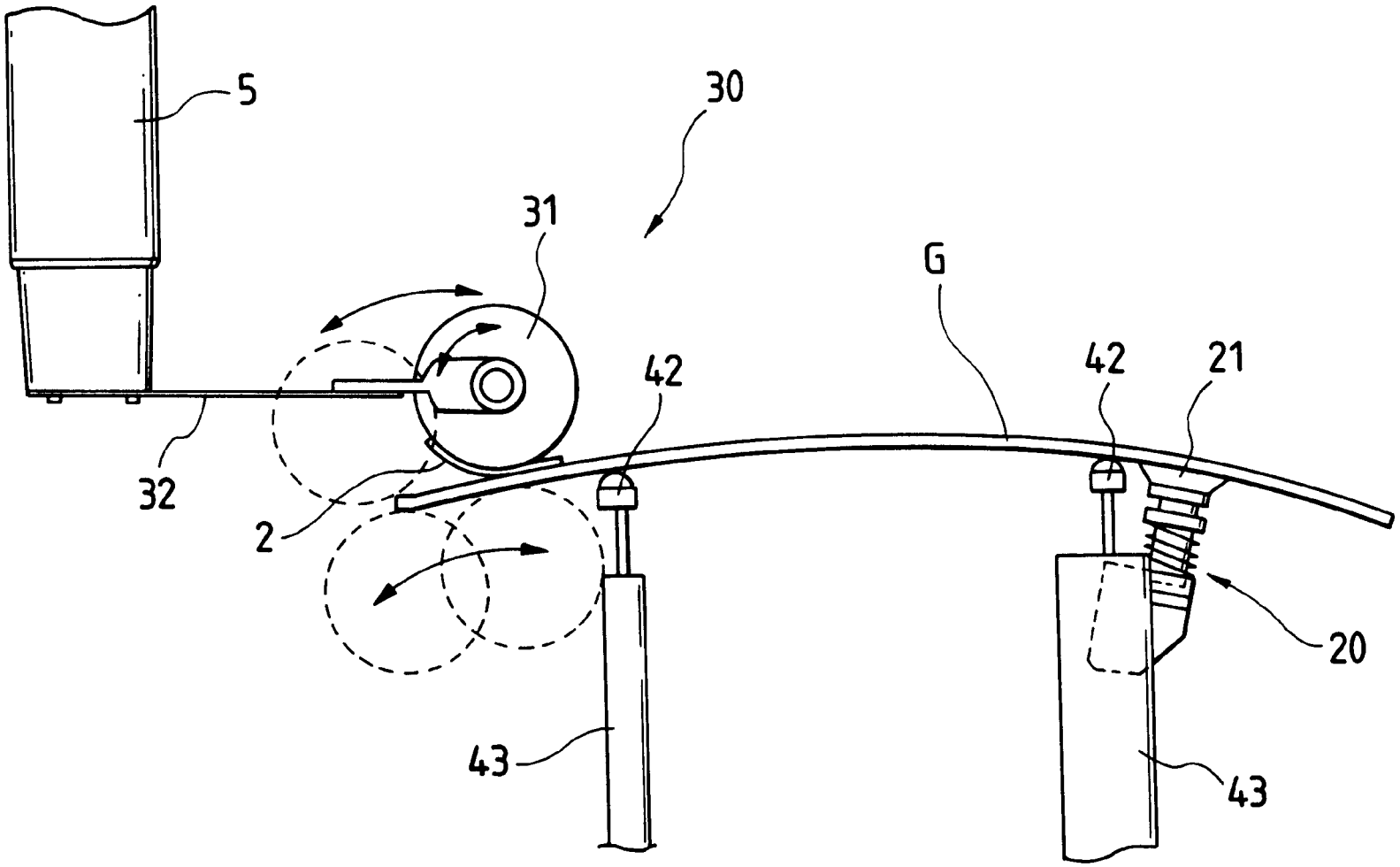
FIG. 3 is a side view of an attaching device of the present invention, for explaining a state where adhesive tape pieces are attached to a plate-like body.

In addition, the attaching unit 30 includes a rotatable attaching roller 31 attached to a plate-like spring 32 provided in a head portion of the robot hand 5 of the robot 100 shown in FIG. 2B. The attaching roller 31 can be moved and rotated desirably by the robot hand 5 which can move and rotate desirably along the X, Y, Z and θ axes. Incidentally, the robot hand 5 may be constructed so as to be movable and rotatable along more than the four axes shown in FIG. 2B (for example, so as to be movable and rotatable along six axes).

Figure 4A:
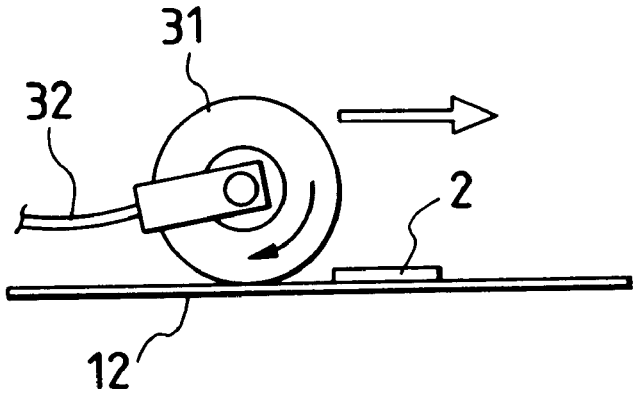
FIGS. 4A to 4C are partially schematic side views for explaining a process where adhesive tape pieces are transferred and put into contact with an attaching roll from a conveyor belt by an attaching device of the present invention.
Figure 4B:
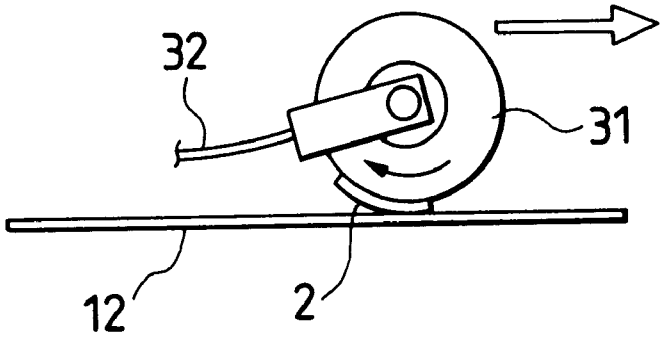
Figure 4C:
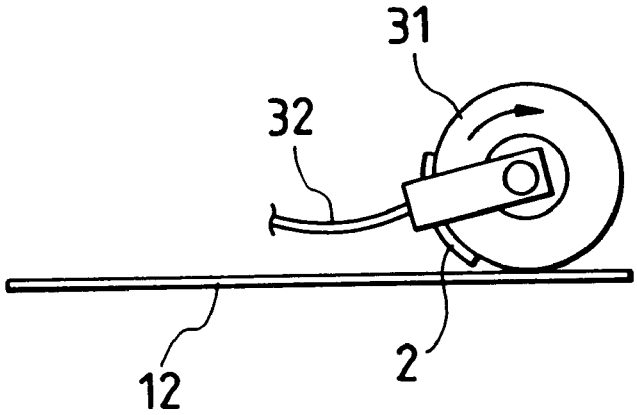

The attaching roller 31 is a kind of rubber roller using silicon rubber in its surface layer or its whole layer and having a smooth surface, so that the attaching roller 31 has adherence in its surface. Accordingly, when the attaching roller 31 is rolled to press the non-paste surfaces (not-adhesive surfaces) of the adhesive tape pieces 2, 2, . . . put in alignment on the conveyor belt 12 as shown in FIG. 4A, the adhesive tape pieces 2, 2, . . . are transferred to the attaching roller 31 and brought into tight contact therewith because of the difference between adhesive strength B between the non-paste surface of the adhesive tape piece 2 and the silicon rubber layer of the attaching roller 31, and adhesive strength A between the adhesive surface of the adhesive tape piece 2 and the conveyor belt 12, as shown in FIGS. 4B and 4C.

That is, if the adhesive strength B between the attaching roller 31 and the non-paste surface of the adhesive tape piece 2 is made larger than the adhesive strength A between the adhesive surface of the adhesive tape piece 2 and the conveyor belt 12, the adhesive tape piece 2 is separated from the conveyor belt 12 and transferred to the attaching roller 31.

Further, being dependent on the size of the adhesive tape pieces 2 cut by the cutter 11, the attaching roller 31 can hold a plurality of adhesive tape pieces 2, 2, . . . aligned on the conveyor belt 12 sequentially so that the not-adhesive surfaces of the adhesive tape pieces 2, 2, . . . are brought into tight contact with the outer circumferential surface of the attaching roller 31 without overlapping one another.

Further, when the adhesive tape pieces 2 are attached to a curved surface of the plate-like body G, the plate-like spring 32 provided in the support portion of the attaching roller 31 follows a change of the curved surface because of the flexibility of the plate-like spring 32. Accordingly, there is no fear that an excess pressing force of the attaching roller 31 is imparted to the plate-like body G to thereby damage the latter. Accordingly, the attaching roller 31 can remove the adhesive tape pieces 2 from the conveyor belt 12 and attach the adhesive tape pieces 2 onto the curved surface of the plate-like body G with a moderate pressing force.

Owing to this plate-like spring 32, it is possible to prevent excessive pressure from acting on the member to be attached as mentioned above. In addition, because of presence of the buffer function of the plate-like spring 32, it is not necessary to give teaching work to the robot accurately. Accordingly, it is possible to simplify the attaching unit.

Figure 5A:
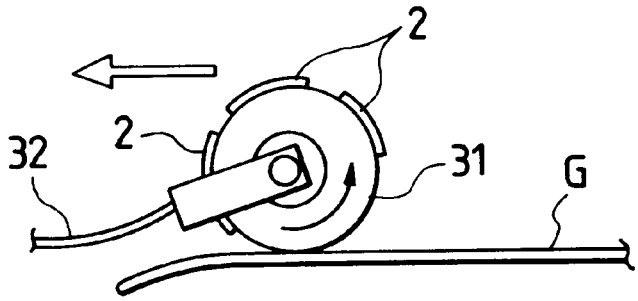
FIGS. 5A to 5C are partially schematic side views for explaining a state where adhesive tape pieces are attached onto a plate-like body from the outer circumferential surface of an attaching roll by an attaching device of the present invention.
Figure 5B:
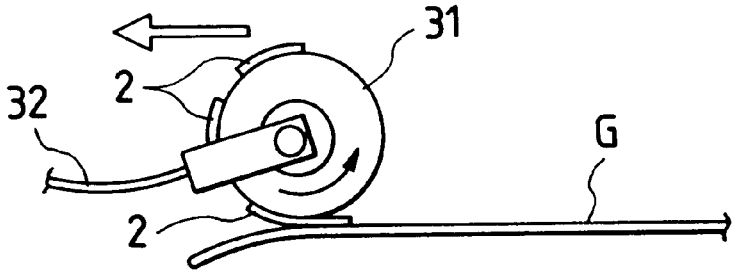
Figure 5C:
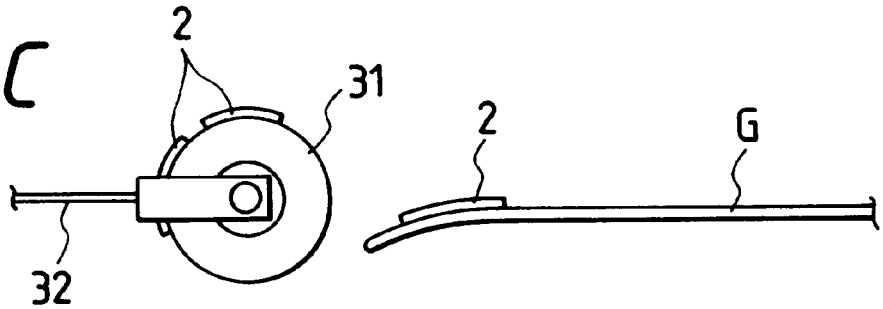

When the adhesive tape pieces 2 adhering on the outer circumferential surface of the attaching roller 31 is to be attached to a desired position of the plate-like body G, the adhesive strength C between the adhesive surface of the adhesive tape piece 2 and the plate-like body G which is a member to be attached is set to be larger than the adhesive strength B between the attaching roller 31 and the non-paste surface of the adhesive tape piece 2. As shown in FIG. SA, one end side of the adhesive tape piece 2 adhering on the outer circumferential surface of the attaching roller 31 is moved to a desired position of the plate-like body G. Then, the adhesive tape pieces 2 adhering to the outer circumferential surface of the attaching roller 31 are pressed one by one onto the plate-like body G sequentially while the attaching roller 31 is rolled. Thus, the adhesive tape pieces 2 are separated one by one from the outer circumferential surface of the attaching roller 31 as shown in FIG. 5B. Further the attaching roller 31 is pressed, while rolling, on the surface of the plate-like body G, the adhesive tape pieces 2 are transferred one by one onto the surface of the plate-like body G and brought into tight contact therewith as shown in FIG. 5C.

That is, the following relation is established: adhesive strength A<adhesive strength B<adhesive strength C wherein:

adhesive strength A . . . adhesive strength between the adhesive surface (paste surface) of the adhesive tape piece 2 and the conveyor belt 12 adhesive strength B . . . adhesive strength between the attaching roller 31 and the non-paste surface of the adhesive tape piece 2 adhesive strength C . . . adhesive strength between the adhesive surface of the adhesive tape piece 2 and the plate-like body G which is a member to be attached.

Further, the plate-like body G is conveyed by a conveyor unit (not shown). The plate-like body G is supported on supporting rods 42 and 42 provided in the top portions of a pair of fixed supports 43 and 43 respectively and having a predetermined height.

In addition, an absorption unit 20 is provided at least one place of either one or both sides of each of the fixed supports 43 and 43 so that the absorption surface of an absorption pad 21 is made to face up and the absorption surface is disposed in the position having substantially the same height as that of the supporting rod 42. Accordingly, the absorption pad 21 absorbs the lower surface of the plate-like body G and fixes the plate-like body G.

Although the tape feeding unit 10 is designed to feed the adhesive tape pieces 2 obtained by cutting the roll-like adhesive tape 2' by the cutter 11 onto the conveyor belt 12, adhesive tape may be cut into pieces of a predetermined size in advance, put on peeling sheet in tight contact therewith and formed into a roll shape. Accordingly, the cut pieces are supplied onto the conveyor belt 12 while the adhesive tape pieces are separated from the peeling sheet.

As the support body, a rotary-type disc rotatable in accordance with the feed timing of the adhesive tape pieces 2 may be used instead of the conveyor belt 12, or a belt constituted by meshes may be used. Further, a fixed pedestal or the like may be used.

The robot 100 may be an articulated multiaxial robot or a double housing orthogonal robot.

The direction of the conveyor belt 12 conveying the adhesive tape pieces 2 is not limited to a direction perpendicular to the direction of conveying the plate-like body G as shown in FIG. 1, but the conveyor belt 12 may be in any position and in any direction so long as the vicinity of the head of the conveyor belt 12 comes into the range in which the robot hand 5 can operate. The conveyance surface is not limited to be horizontal but may be inclined more or less.

Although the spring 32 provided in the support portion of the attaching roller 31 is constituted by a plate-like flexible spring, any spring may be used so long as it has enough force to restore itself to its original shape after transformation. For example, a coil-like flexible metal pipe may be replaced by the plate-like spring. Alternatively, the attaching roller 31 may be provided at the head of a not-flexible rigid member through a coil spring so as to compress and transform the coil spring when the attaching roller 31 presses a member to be attached, and to expand and contract the attaching roller 31 desirably by the restoring force of the coil spring.

The attaching roller used in the present invention does not require any mechanism for controlling attaching, any driving source, and any supply of a bonding agent at all. The attaching roller can be used only with maintenance to clean its surface periodically.

Original gummed tape pieces in which adhesive strength is generated when it is made wet may be used instead of the adhesive tape pieces 2 used in the present invention. In this case, it will go well if the surface of the portion of a member to be attached is made wet in advance by a wetting unit (not-shown), or if the gummed tape pieces adhering onto the attaching roller 31 are pressed to sponge containing water or the like so as to get the gummed tape pieces wet.

EXAMPLE

The usage and operation of a method and a device for attaching adhesive tape according to the present invention will be described below.

As an embodiment, for example, roll-like adhesive tape 2' having a width in a range of from 20 to 100 mm and a length of hundreds meters is prepared. As shown in FIG. 1, the roll-like adhesive tape 2' is set in a holder 3 of a tape feeding unit 10, and the head of the adhesive tape 2' is led to a cutter 11 through a gap between guide rolls 13. The cutter 11 cuts the adhesive tape 2' into a desired size, for example, a length in a range of from 50 to 100 mm. The tape feeding unit 10 discharges aplurality of cut tape pieces onto a conveyor belt 12 at suitable intervals.

The cut adhesive tape pieces 2 are put in alignment with their adhesive surfaces down on the conveyor belt 12 having a rough surface coated with silicon. Thus, the adhesive tape pieces 2 are ready to be taken out one by one in the order from the forward end side of the conveyor belt 12 by means of an attaching roller 31 of an attaching unit 30.

Since the conveyor belt 12 has a rough surface coated with silicon, the paste surfaces of the adhesive tape pieces 2 are not bonded with the conveyor belt 12 even if the adhesive tape pieces 2 are in contact with the conveyor belt 12.

Now, the attaching roller 31 which has, for example, a diameter in a range of from 50 to 150ϕ and a length in a range of from 60 to 200 mm is attached to the head of a hand 5 of a robot. The attaching roller 31 is moved to a position above the adhesive tape piece, closest to the forward end side of the conveyor belt, of the adhesive tape pieces 2, 2, . . . put on the conveyor belt 12.

While rolling the attaching roller 31 on the conveyor belt 12, the attaching roller 31 is pressed onto the adhesive tape piece 2 on the conveyor belt 12, so that the adhesive tape piece 2 is transferred to the attaching roller 31 from the conveyor belt 12. Four to six adhesive tape pieces 2, 2, . . . are respectively brought into tight contact with the outer circumferential surface of one and the same attaching roller 31 without overlapping one another.

Since the outer circumferential layer of the cylindrical attaching roller 31 is made of a silicon rubber, the attaching roller 31 can easily cling the adhesive tape by pressing the attaching roller 31 from the non-paste surface side of the adhesive tape piece made of elastic and soft resin.

Here, the plate-like body G is positioned by a positioning unit (not shown) in advance and is conveyed by a conveyor unit (not shown). Then, the plate-like body G is conveyed to the vicinity of the adhesive tape attaching device 1, and is put on supporting rods 42 and 42.

As soon as the plate-like body G is put on the supporting rods 42 and 42, absorption pads 21 and 21 of an absorption unit 20 provided outside fixed supports 43 and 43 absorb and fix the lower surface of the plate-like body G.

As shown in FIG. 2A, the attaching roller 31 is moved to a predetermined position of the plate-like body G fixed by the absorption pads 21 and 21, and the attaching roller 31 is rolled, while being pressed, on the plate-like body G in the position to be attached so that the adhesive tape piece 2 is transferred from the attaching roller 31 and attached onto the plate-like body G. In the same manner, the adhesive tape pieces 2, 2, . . . are attached sequentially to two or three places on the front surface of the plate-like body G and two to four places on the back surface.

Since the support portion of the attaching roller 31 and the robot hand 5 are connected to each other through a plate-like spring 32, flexibility of the plate-like spring 32 prevents excessive force of the attaching roller 31 from acting on the conveyor belt 12 or the plate-like body G even if the attaching roller 31 is intensively pressed onto the conveyor belt 12 or the plate-like body G. In addition, even if the plate-like body G is curved, it is not necessary to press the attaching roller 31 along the curved surface accurately. That is, because of the flexibility of the spring 32, the attaching roller 31 can be put into tight contact with the curved surface if the attaching roller 31 is pressed merely slightly close to the curved surface.

When a predetermined number of adhesive tape pieces 2 have been attached onto the opposite surfaces of the plate-like body G, the absorption pads 21 for absorbing and fixing the plate-like body G are released, and the plate-like body G is conveyed to the next process by the conveyor means (not shown).

Although a preferred example has been described, the present invention is not limited to this, but various applications may be considered.

Bodies of various shapes such as plate-like bodies, cylindrical bodies, cubic bodies, rectangular bodies, deformed solid bodies, etc. may be suitable as members to be attached.

In addition, the plate-like body G maybe a flat or curved glass plate, a panel material, a metal plate, a resin plate, or the like. A glass plate may be a single plate selected from a reinforced glass plate, a half-reinforced glass plate, a raw plate and so on; or a combined glass plate in which a plurality of reinforced glass plates or a combination of reinforced glass and raw plate glass are bonded with each other with an intermediate film such as PVB, EVA, or the like or injected resin.

Although the adhesive tape pieces 2, 2, . . . are obtained by cutting a roll-like adhesive tape 2' into a predetermined length by means of the cutter 11 of the tape feeding unit 10, the cut length may be changed variously on the way of cutting by a controller (not shown), and the adhesive tape pieces 2, 2, . . . different in cut size may be conveyed in mixture but with regularity. In this case, the attaching roller 31 must receive the adhesive tape pieces 2, 2, . . . in order based on information corresponding to the regularity in cutting.

In such a manner, when there occurs necessity of attaching two kinds of adhesive tape pieces 2, 2, . . . different in length to different portions of the one plate-like body G, it is possible to attach the adhesive tape pieces 2, 2, . . . each having a desired length to desired positions of the plate-like body G if the adhesive tape pieces 2, 2, . . . cut into two kinds of sizes are conveyed in order with regularity.

According to the present invention, with a simple structure, it is possible to attach adhesive tape pieces to desired positions, sequentially and automatically, at a plurality of places on the opposite surfaces of an article of various shapes, particularly, of a plate-like body having a curved surface.

In addition, since an attaching roller and a robot hand which constitute an attaching unit are connected to each other through a plate spring, the attaching roller can follow the curved surface of the plate-like body by the flexibility of the plate spring when attaching is performed upon the curved surface. Accordingly, there is no fear that an excessive pressing force of the attaching roller is imparted to the plate-like body, so that the plate-like body can be prevented from being damaged. It is possible to attach adhesive tape pieces to the plate-like body having the curved surface with a moderate pressing force.

In addition, since the adhesive tape pieces adhering on the attaching roller are attached by a robot having high degrees of freedom, attaching posture to a member to be attached is not limited, but partial attaching of adhesive tape pieces can be realized.

Further, since adhesive tape pieces come into tight contact with the outer circumferential surface of the attaching roller are attached one by one and little by little with the rotational movement of the roller, it is possible to attach the adhesive tape pieces to a member to be attached without producing bubbles or wrinkles.

Furthermore, by extending the conveyor belt, it is possible to supply and exchange adhesive tape safely from the outside of the mechanical operation range of a robot or the like.

The present disclosure relates to the subject matter contained in Japanese patent application No. Hei. 10-109587 filed on Apr. 20, 1998 which is expressly incorporated herein by reference in its entirely.

While only certain embodiments of the invention have been specifically described herein, it will apparent that numerous modification may be made thereto without departing from the spirit and scope of the invention.

What is claimed is:

1. A device for attaching an adhesive tape comprising:

a tape cutting means for cutting a roll-form adhesive tape into adhesive tape pieces;

a tape feeding means including a conveyor belt for conveying said adhesive tape pieces disposed thereon with their adhesive surfaces down so as to be in contact with said conveyor belt;

an attaching roller having enough adhesive strength to press not-adhesive surfaces of said adhesive tape pieces arranged on said conveyor belt so that said adhesive tape pieces are transferred to come into tight contact with said attaching roller; and a robot making said attaching roller movable and rotatable.

2. A device for attaching an adhesive tape according to claim 1, wherein at least surface layer portion of said attaching roller is formed of a silicon rubber layer having a smooth surface.

3. A device for attaching an adhesive tape according to claim 1, wherein a conveyor surface of said conveyor belt is subjected to roughing, and coated with silicon.

4. A device for attaching an adhesive tape according to claim 1, wherein a conveyor surface of said conveyor belt is subjected to embossing finish, and coated with silicon.

5. A device for attaching adhesive tape according to claim 1, further comprising:

a flexible member provided in a support portion of said attaching roller, so as to reduce a pressing force of said attaching roller onto said conveyor belt and a member to be attached.

6. A device for attaching an adhesive tape according to claim 5, wherein said flexible member is constructed by a spring.

7. A device for attaching an adhesive tape according to claim 5, wherein said flexible member is a flexible metal pipe.

* * * * *